US009559443B2

(12) United States Patent
Boutin

(10) Patent No.: US 9,559,443 B2
(45) Date of Patent: Jan. 31, 2017

(54) ELECTRICAL CONNECTORS HAVING FIELD MODIFIABLE LUGS

(71) Applicant: Hubbell Incorporated, Shelton, CT (US)

(72) Inventor: Kris Robin Boutin, Mont Vernon, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 14/941,308

(22) Filed: Nov. 13, 2015

(65) Prior Publication Data

US 2016/0141774 A1 May 19, 2016

Related U.S. Application Data

(60) Provisional application No. 62/079,764, filed on Nov. 14, 2014.

(51) Int. Cl.

| | |
|---|---|
| ***H01R 9/24*** | (2006.01) |
| ***H01R 11/11*** | (2006.01) |
| ***H01R 11/12*** | (2006.01) |
| *H01R 43/16* | (2006.01) |

(52) U.S. Cl.

CPC ..... *H01R 11/11* (2013.01); *H01R 11/12* (2013.01); *H01R 43/16* (2013.01)

(58) Field of Classification Search

CPC ..... H01R 11/11; H01R 11/09; H01R 4/30
USPC ..... 439/518, 889, 883, 884
See application file for complete search history.

(56) References Cited

U.S. PATENT DOCUMENTS

| | | | | | |
|---|---|---|---|---|---|
| 1,579,008 | A * | 3/1926 | Lake, Jr. | H01R 4/10 | 439/860 |
| 1,847,689 | A * | 3/1932 | Gribbie | H01R 11/12 | 439/883 |
| 2,406,079 | A * | 8/1946 | Krueger | H01R 4/16 | 29/12 |
| 2,724,815 | A * | 11/1955 | Sisco | H01R 11/281 | 24/115 G |
| 2,748,452 | A * | 6/1956 | Pierce | H01R 13/115 | 206/717 |
| 3,569,919 | A * | 3/1971 | Daddona, Jr. | H01R 13/20 | 439/848 |
| 3,777,301 | A * | 12/1973 | Michaels | H01R 25/00 | 439/749 |
| 3,857,349 | A * | 12/1974 | Pritulsky | B21D 53/24 | 29/874 |

(Continued)

OTHER PUBLICATIONS

International Search Report from corresponding International Patent Application No. PCT/US2015/060702 dated Feb. 1, 2016.

(Continued)

*Primary Examiner* — Tulsidas C Patel
*Assistant Examiner* — Peter G Leigh
(74) *Attorney, Agent, or Firm* — Ohlandt, Greeley, Ruggiero & Perle, L.L.P.

(57) ABSTRACT

Electrical connectors having field modifiable lugs are provided. In some embodiments, the electrical connectors include a lug having at least two different modification guide features, which assist the user to modify lug from its blank or unmodified state shown in to a modified state while ensuring that the modified connector maintains the desired compliance to the various regulatory and overseeing bodies.

14 Claims, 4 Drawing Sheets

(56) References Cited

U.S. PATENT DOCUMENTS 4,085,989 A * 4/1978 McCardell ..... H01R 4/34 439/595
4,943,247 A * 7/1990 Wise ..... H01R 4/34 439/883
4,983,133 A * 1/1991 Van Scyoc ..... H01R 11/12 439/860
5,108,320 A * 4/1992 Kimber ..... H01R 11/12 439/801
5,662,504 A * 9/1997 Krivec ..... H01R 11/287 439/755
6,059,594 A * 5/2000 Davis ..... H01R 13/5205 439/275
6,206,718 B1 * 3/2001 Takahashi ..... H01R 4/308 439/382
6,280,263 B1 * 8/2001 Manor ..... H01R 11/26 439/801
6,319,078 B1 * 11/2001 Thorner ..... H01R 11/12 439/883
6,599,137 B2 * 7/2003 Modina ..... H01R 4/305 439/459
6,607,409 B2 * 8/2003 Machado ..... H01R 11/282 439/855
6,613,263 B2 * 9/2003 Kondo ..... H01R 4/70 264/263
6,676,455 B2 * 1/2004 Machado ..... H01R 11/282 439/855
6,783,377 B2 * 8/2004 Aoyama ..... H01R 11/12 439/92
6,969,276 B2 * 11/2005 Ono ..... H01R 11/26 439/287
7,070,461 B1 * 7/2006 Pavlovic ..... H01R 11/12 439/766
7,467,968 B1 * 12/2008 Sink ..... H01R 43/16 439/491
7,491,101 B2 * 2/2009 Irish ..... H01R 11/22 439/853
7,530,843 B1 * 5/2009 Tesfay ..... H01R 4/183 439/587
7,828,613 B2 * 11/2010 Chen ..... H01R 4/34 439/883
7,955,101 B2 6/2011 Lawson et al.
7,955,123 B2 * 6/2011 Wirth ..... H01L 31/0508 136/256
8,128,431 B2 * 3/2012 Kato ..... H01R 13/521 439/271
8,202,102 B2 * 6/2012 Kim ..... H01R 11/12 439/92
8,382,535 B2 2/2013 Wertherman et al.
8,622,776 B2 * 1/2014 Morikawa ..... H01R 4/185 439/883
9,287,637 B2 * 3/2016 Therrien ..... H01R 4/38
9,373,910 B2 * 6/2016 Sato ..... H01R 43/005
2008/0182462 A1 * 7/2008 Werthman ..... H01R 11/12 439/884
2010/0087106 A1 * 4/2010 Lawson ..... H01R 11/12 439/884
2012/0208410 A1 * 8/2012 Ikeda ..... H01M 2/206 439/883

OTHER PUBLICATIONS

Written Opinion from corresponding International Patent Application No. PCT/US2015/060702 dated Feb. 1, 2016.

* cited by examiner

ELECTRICAL CONNECTORS HAVING FIELD MODIFIABLE LUGS

CROSS REFERENCE TO RELATED APPLICATIONS

This application claims the benefit of U.S. Provisional Application Ser. No. 62/079,764 filed Nov. 14, 2014, the contents of which are incorporated by reference herein.

BACKGROUND

1. Field of the Disclosure

The present disclosure is related to electrical connectors. More particularly, the present disclosure is related to electrical connectors having lugs that can be modified or customized in the field.

2. Description of Related Art

Electrical connectors having a lug are known. Such electrical connectors are used to connect one or more electrical conductors to one another and/or to a terminal or bus.

Due to the many uses of the electrical connectors, the lugs can take any number of sizes and have any number of holes. To reduce the number of electrical connectors carried to a particular job site, some users have been known to modify the size of the lugs and/or to modify the location/size/number of holes in the lug to meet their particular needs in the field as needed.

Unfortunately, modifications to the length of the lugs can void the approval from one or more regulatory bodies such as, but not limited to, the Underwriters Laboratory, Inc. ("UL"), the National Fire Protection Association (NFPA), and others and/or can be contrary to one or more requirements set forth by governmental or trade organizations. Furthermore, modifications to the location/size/number of holes in the lugs can also void the regulatory approval and/or be contrary to various requirements.

Accordingly, it has been determined by the present application that there is a need for electrical connectors with field modifiable or customizable lugs that assist the user in maintaining the desired compliance to the various regulatory and overseeing bodies.

SUMMARY

Electrical connectors having field modifiable lugs are provided. In some embodiments, the electrical connectors include a lug having at least two different modification guide features, which assist the user to modify lug from its blank or unmodified state shown in to a modified state while ensuring that the modified connector maintains the desired compliance to the various regulatory and overseeing bodies.

In some embodiments, an electrical connector is provided that includes a conductor-connecting region and a terminal-connecting region having at least two different modification guide features, which are configured to assist a user to modify the terminal-connecting region from a blank or unmodified state to a modified state.

In some embodiments, one of the two different modification guide features is a weakened section at which the user can modify a dimension of the terminal-connecting region along the weakened section. Here, the weakened section can be on a surface of the terminal-connecting region selected from the group consisting of a top surface, a bottom surface, and combinations thereof. The weakened section can be a plurality of weakened sections. The dimension that is modified can include a length of the terminal-connecting region, a width of the terminal-connecting region, and combinations thereof.

In some embodiments alone or in combination with one or more of the above described embodiments, one of the two different modification guide features can include a pilot section at which the user can modify the terminal-connecting region to include one or more holes at the pilot section. The pilot section can be a plurality of pilot sections. The pilot section can be printed indicia, a score line, and combinations thereof. The pilot section can be on a surface of the terminal-connecting region selected from the group consisting of a top surface, a bottom surface, and combinations thereof.

The above-described and other features and advantages of the present disclosure will be appreciated and understood by those skilled in the art from the following detailed description, drawings, and appended claims.

DETAILED DESCRIPTION

Figure 1:
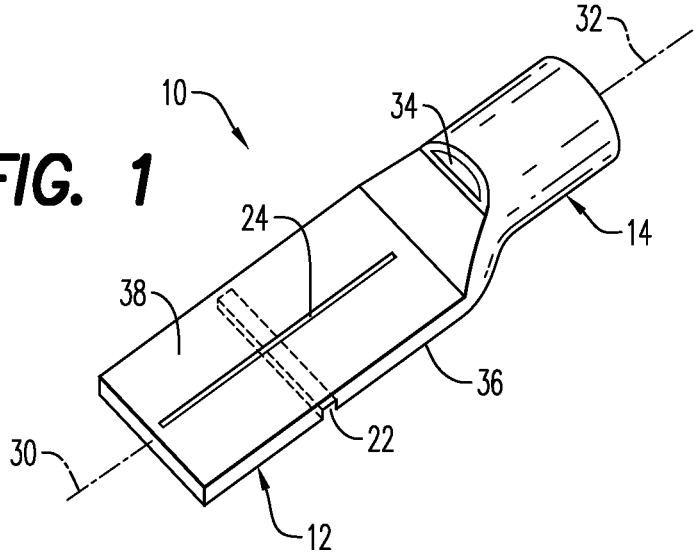
FIG. 1 is a perspective view of an exemplary embodiment of an electrical connector according to the present disclosure before modification.
Figure 2A:
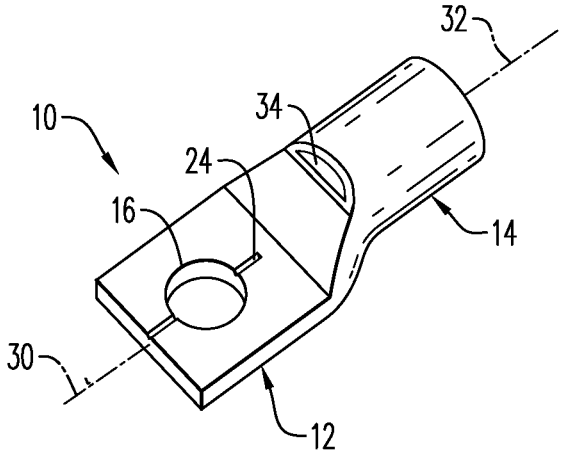
FIG. 2*a* is a perspective view of the electrical connector of FIG. 1 after a first type of modification to include a single hole and before use.
Figure 2B:
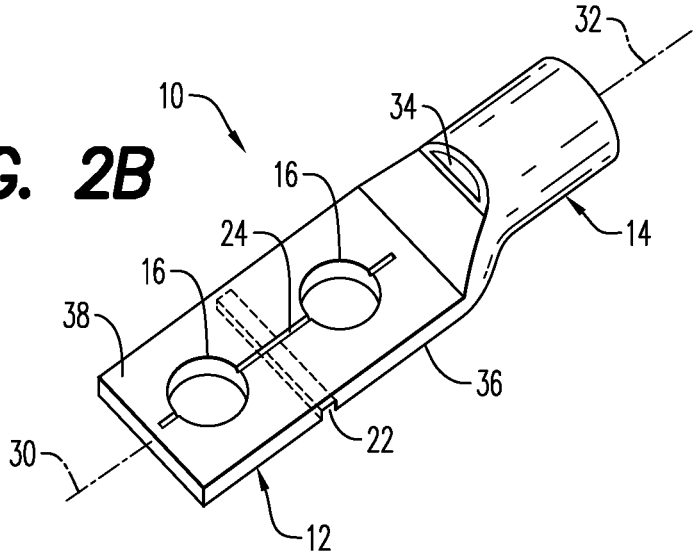
FIG. 2*b* is a perspective view of the electrical connector of FIG. 1 after a second type of modification to include two holes and before use.
Figure 3:
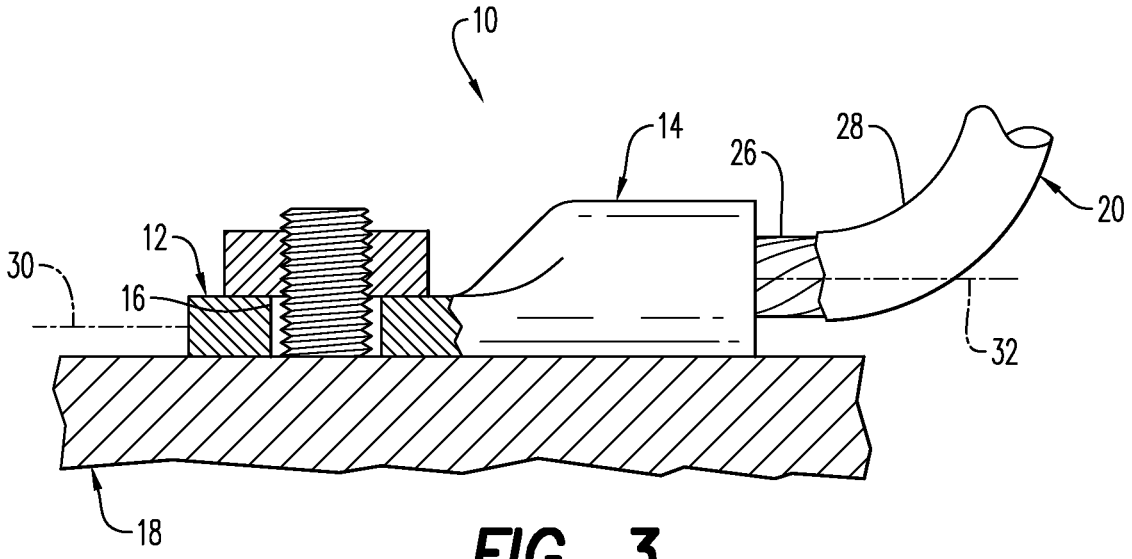
FIG. 3 is a partial sectional view of the modified electrical connector of FIG. 2*a* in use.

Referring to the drawings and in particular to FIGS. 1 through 3, a perspective view of an exemplary embodiment of an electrical connector according to the present disclosure is shown and is generally referred to by reference numeral 10. Connector 10 includes a first or terminal-connecting region 12 and a second or conductor-connecting region 14. First or terminal-connecting region 12 is often referred to in the art as a lug or tongue or pad. For reasons of clarity, region 12 will be referred herein as a lug.

Connector 10 is shown in FIG. 1 before modification of lug 12, in FIG. 2*a* after modification of the lug to a reduced length and to include connecting hole 16, in FIG. 2*b* after modification of the lug to include two connecting holes 16, and in FIG. 3 after connection of the lug to a terminal 18 using the hole and connection of second region 14 to an electrical conductor 20.

Advantageously, connector 10 includes lug 12 having at least two different modification guide features, which are described in more detail below. The modification guide features assist the user to modify lug 12 from its blank or unmodified state shown in FIG. 1 to its field modified states in FIGS. 2*a* and 2*b*. Moreover, the modification guide features assist the user to ensure that the modified connectors 10 of FIGS. 2*a* and 2*b* maintain the desired compliance to the various regulatory and overseeing bodies when modified in the field.

In its simplest form illustrated in FIG. 1, connector 10 of the present disclosure includes lug 12 having a weakened section 22 as one of the modification guide features and a pilot section 24 as the other modification guide feature. In this manner, the user can modify the length of connector 10 by breaking lug 12 along weakened section 22 and can modify the number and/or location and/or size of hole(s) 16 using pilot section 24.

Connector 10 can be made of any conductive material such as, but not limited to, tin, steel, copper, silver, gold, aluminum, any alloys thereof. Moreover, the electrical connector can be plated or otherwise coated with any conductive material.

Second region 14 is connected to conductor 20 in an electrically conductive manner. Here, conductor 20 can include an electrically conductive core 26 that, in some embodiments is surrounded by an insulating sheath 28. Sheath 28 is removed from core 26 at least in the area where conductor 20 is connected to second region 14.

Second region 14 can secure conductor 20 in any desired manner that provides sufficient electrical conduction between core 26/connector 10 and provides sufficient strength to avoid inadvertent removal of the conductor from the connector.

In some embodiments, second region 14 can be configured to form a compression connection onto conductor 20. Specifically, second region 14 can be compressed or deformed onto core 26 using a circumferential compression, an indent compression, and combinations thereof.

In other embodiments, second region 14 can be configured to form a mechanical connection onto conductor 20. Specifically, second region 14 can include one or more set screws, rivets or other mechanical connection (not shown) that secures core 26 in the second region.

In still embodiments, second region 14 can be configured to form an adhered connection with core 26 of conductor 20. Here, an electrically conductive adhesive (not shown) can secure core 26 in second region 14. Furthermore, second region 14 can be configured to form a brazed or welded connection with core 26 of conductor 20 in which an electrically conductive braze or weld (not shown) secures core 26 in second region 14.

In the embodiment illustrated in FIGS. 1-3, connector 10 is configured so that lug 12 and second region 14 are coaxial to one another. Stated another way, lug 12 has a longitudinal axis 30 and second region 14 has a longitudinal axis 32 that are parallel or coincident with one another.

Of course, it is contemplated by the present disclosure for connector 10 to be configured so that that lug 12 and second region 14 are normal or perpendicular to one another. In this embodiment, longitudinal axis 30 of lug 12 and longitudinal axis 32 of second region 14 are arranged normal or perpendicular to one another.

Connector 10 can include, in some embodiments, an inspection window 34 defined in second region 14. Window 34 allows the user to ensure that conductor 20 is fully seated within second region 14—namely that the end of the conductor abuts the portion of second region 14 proximate the window 34.

Additionally, connector 10 can, when conductor 20 is secured within second region 14, further include an insulating cover (not shown) over the intersecting area between the conductor and the second region to ensure coverage or insulation of any portion of core 26 that remains exposed after securement in the second region. In some embodiments, the insulating cover can be a heat shrink wrap tube known in the art.

The first of the modification guide features, weakened section 22, is described in more detail with reference to FIGS. 1 and 2*a*.

Again, modifications to lug 12 could void the UL approval, especially if an installer gets a bit aggressive and removes too much of the lug during installation and assembly.

Weakened section 22 is at least one recess defined in lug 12 that forms an area of breakage of the lug, which provides a guide to the user for changing the length and/or width of the lug.

For reasons of clarity, weakened section 22 is shown in the illustrated embodiment as a single, continuous recess that runs perpendicular to lug axis 30, runs across the entire width of lug 12, and is defined on a bottom surface 36 of the lug. Additionally, weakened section 22 is shown in the illustrated embodiment as having a squared off cross section. In this manner, weakened section 22 is configured to allow the user to modify the length of lug 12—namely shorten the dimension of the lug along axis 30.

Of course, it is contemplated by the present disclosure for weakened section 22 to be multiple recesses, to be continuous or discontinuous, to run parallel to lug axis 30, to run angled with respect to the lug axis, to run across less than the entire width of the lug, to have any desired cross section, to be defined in top surface 38 of the lug, to be defined in both the top and bottom surfaces, and any combinations thereof.

Weakened section 22 allows a user to break lug 12 in a controlled and repeatable manner to any desired length and/or width-based on the number and location of the weakened sections. For example, the user can bend lug 12 at weakened section 22 one or more times and, through metal fatigue, break the lug at the weakened section. As another example, weakened section 22 can be used as a pilot line to guide the user when cutting at the weakened section with a saw or cutter/snips. Advantageously, connector 10 is configured so that one or more weakened sections 22 are positioned on lug 12 in a manner that ensures maintenance of the desired compliance to the various regulatory and overseeing bodies when modified in the field.

The second of the modification guide features, pilot section 24, is also described in more detail with reference to FIG. 1. Here, lug 12 is considered a blank lug in that it lacks hole(s) 16 seen in the modified lug of FIGS. 2*a* and 2*b*. Rather, connector 10 is configured with one or more pilot sections 24 (one shown) that allows the user can modify the lug as needed by drilling one or more thru-holes in lug 12 to the desired diameter and spacing which suits the particular application.

Pilot section 24 is at least a printed or indicia line or marking that provides a predefined location on lug 12 as a template to the user to eliminate any guesswork in locating or spacing of thru holes and to speed up the process of creating the holes for the installation of hardware and completion of the application.

In some embodiments, pilot section 24 can include one or more surface depressions in the surface of lug 12. The surface depressions may be provided at any number of industry standard spacings for holes 16. Accordingly, pilot section 24 provides the unmodified connector 10 of FIG. 1 with a locator template ready for the user to be used as a guide to modify the connector to any desired pattern for one or more holes 16.

In other embodiments, pilot section 24 can be a knurled depression in the surface of lug 12. The knurled depression can have any desired pattern such as, but not limited to a crisscross pattern, series of straight ridges, a helix of straight ridges, and others. Without wishing to be bound by any particular theory, it has been found by the present disclosure that the knurled depression can prevent and/or reduce instances of a drill bit "walking" or moving within pilot section 24 from a desired location. Thus, it is believed that the knurled depression of pilot section 24 can assist in ensuring that the one or more holes 16 drilled using the pilot section are in the desired location.

For ease of discussion, connector 10 is shown having a single pilot section 24 that is a score or depression line that runs along axis 30 of lug 12 to mark the center of holes 16. The depression of pilot section 24 has sufficient depth to provide a pilot or guide to prevent walking or wandering of the drill bit during field modification, but without affecting the structural rigidity of lug 12.

Advantageously, connector 10 is configured so that one or more pilot section 24 are positioned on lug 12 in a manner that ensures maintenance of the desired compliance to the various regulatory and overseeing bodies when modified in the field. Thus, connector 10 having one or more pilot sections 24 provides a template to the user to eliminate any guesswork in selecting a drilling location and speeds up the process of creating the holes within lug. Pilot sections 24 provide the user with pre-defined drill points that would provide consistently located thru-holes.

It should be recognized that pilot section 24 is disclosed herein as being present on top surface 38 of lug 12. However, it is contemplated by the present disclosure for pilot section 24 to defined in/or bottom surface 36 and/or on both the top and bottom surfaces, and any combinations thereof.

Connector 10 combines both weakened section 22 and pilot section 24 to provide lug 12 with previously unavailable flexibility and modifiability, while remaining capable of maintaining the desired compliance to the various regulatory and overseeing bodies when modified in the field.

In the embodiment of FIG. 1, weakened section 22 is provided on bottom surface 36 and pilot section 24 is provided on top surface 38 to avoid any interference between the two modification guide features. For example, the intersection of sections 22, 24 can occur in a location near where a user may need to place hole 16 and it has been determined by the present disclosure that this intersection, particularly where pilot section 24 is a depression, may result in the drill bit wandering into the intersection instead of the desired location.

Figure 4:
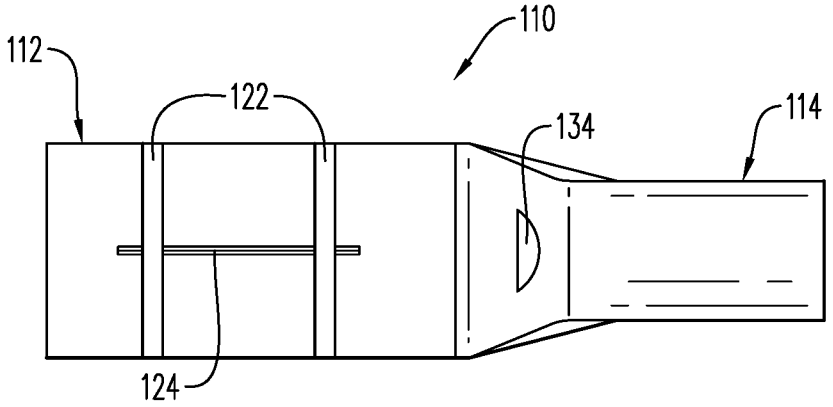
FIG. 4 is a top view of another exemplary embodiment of an electrical connector according to the present disclosure before modification.
Figure 5:
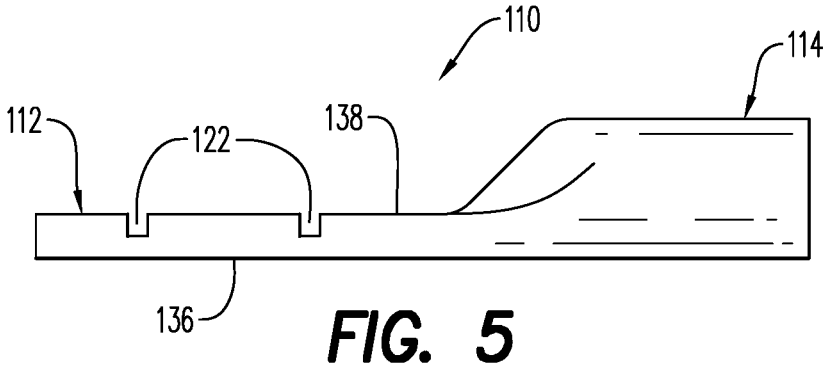
FIG. 5 is a side view of the electrical connector of FIG. 4.

An alternate embodiment of an electrical connector according to the present disclosure is shown in FIGS. 4 and 5 and is generally referred to by reference numeral 110. Here, component parts performing similar and/or analogous functions to those described above with respect to connector 10 are numbered in multiples of 100.

Connector 110 includes a lug 112 and a second region 114 and is shown in FIGS. 4 and 5 before modification. Again, connector 110 includes lug 112 having at least two different modification guide features that assist the user to modify the lug the from its blank or unmodified state and ensures that the modified lug maintains the desired compliance to the various regulatory and overseeing bodies when modified in the field.

Connector 110 of the present disclosure includes lug 112 having a plurality of weakened sections 122 as one of the modification guide features and a plurality of pilot sections 124 as the other modification guide feature.

Connector 110 can include, in some embodiments, an inspection window 134 defined in second region 114, which allows the user to ensure that the conductor is fully seated within second region 114—namely that the end of the conductor abuts the portion of second region 114 proximate the window.

Weakened sections 122 are recesses defined in lug 112 that forms an area of breakage of the lug, which provides a guide to the user for changing the length and/or width of the lug. Weakened sections 122 are shown in the illustrated embodiment as a single, continuous recess that runs perpendicular to the lug axis, runs across the entire width of lug 112, and are defined on a top surface 138 of the lug. Additionally, weakened sections 122 are shown in the illustrated embodiment as having a squared off cross section. In this manner, weakened section 122 is configured to allow the user to modify the length of lug 112—namely shorten the dimension of the lug along the lug axis.

Of course, it is contemplated by the present disclosure for weakened sections 122 to be multiple recesses, to be continuous or discontinuous, to run parallel to the lug axis, to run angled with respect to the lug axis, to run across less than the entire width of the lug, to have any desired cross section, to be defined in bottom surface 136 of the lug, to be defined in both the top and bottom surfaces, and any combinations thereof.

Weakened sections 122 allows a user to break lug 112 in a controlled and repeatable manner to any desired length and/or width-based on the number and location of the weakened sections. For example, the user can bend lug 112 at either weakened section 122 one or more times and, through metal fatigue, break the lug at the weakened section. As another example, weakened section 122 can be used as a pilot line to guide the user when cutting at the weakened section with a saw or cutter/snips. Advantageously, connector 110 is configured so that weakened sections 122 are positioned on lug 112 in a manner that ensures maintenance of the desired compliance to the various regulatory and overseeing bodies when modified in the field.

The second of the modification guide features, a plurality of pilot sections 124, are also described in more detail with reference to FIGS. 4 and 5. Again, lug 112 is considered a blank lug in that it lacks any hole. Rather, connector 110 is configured with the plurality of pilot sections 124 that allow the user can modify the lug as needed by drilling one or more thru-holes in lug 112 to the desired diameter and spacing which suits the particular application.

Pilot sections 124 are at least a printed or indicia lines or markings that provide predefined locations on lug 112 as a template to the user to eliminate any guesswork in locating or spacing of thru holes and to speed up the process of creating the holes for the installation of hardware and completion of the application.

In some embodiments, pilot sections 124 can include one or more surface depressions in the surface of lug 112. The surface depressions may be provided at any number of industry standard spacings for the holes. Accordingly, pilot sections 124 provides the unmodified connector 110 of FIGS. 4 and 5 with a locator template ready for the user to be used as a guide to modify the connector to any desired pattern for one or more holes.

It should be recognized that pilot sections 124 are disclosed herein as being present on top surface 138 of lug 112. However, it is contemplated by the present disclosure for pilot sections 124 to defined in/or bottom surface 136 and/or on both the top and bottom surfaces, and any combinations thereof.

Connector 110 combines both weakened sections 122 and pilot sections 124 to provide lug 112 with previously unavailable flexibility and modifiability, while remaining capable of maintaining the desired compliance to the various regulatory and overseeing bodies when modified in the field.

Figure 6:
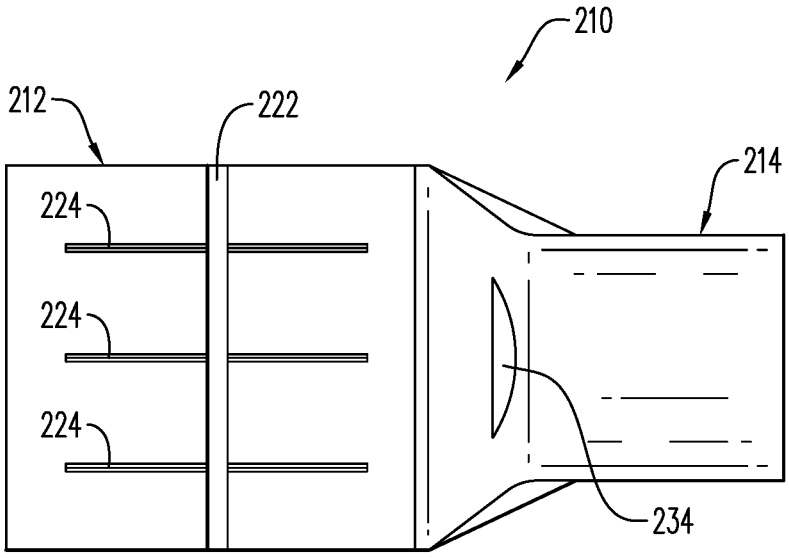
FIG. 6 is a top view of still another exemplary embodiment of an electrical connector according to the present disclosure before modification.
Figure 7:
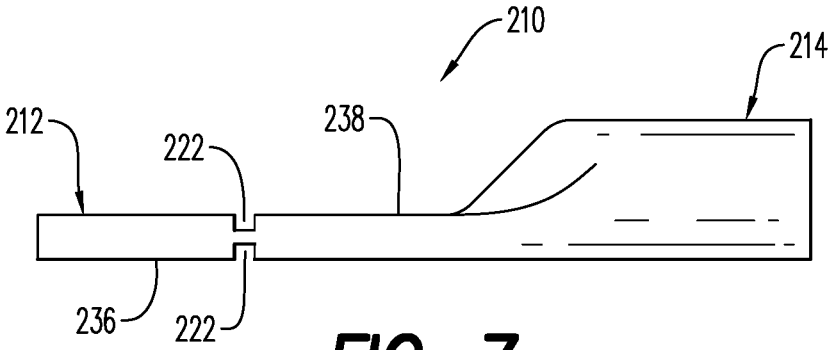
FIG. 7 is a side view of the electrical connector of FIG. 6.

Another alternate embodiment of an electrical connector according to the present disclosure is shown in FIGS. 6 and 7 and is generally referred to by reference numeral 210. Here, component parts performing similar and/or analogous functions to those described above with respect to connector 10 are numbered in multiples of 200.

Connector 210 includes a lug 212 and a second region 214 and is shown in FIGS. 5 and 7 before modification. Again, connector 210 includes lug 212 having at least two different modification guide features that assist the user to modify the lug the from its blank or unmodified state and ensures that the modified lug maintains the desired compliance to the various regulatory and overseeing bodies when modified in the field.

Connector 210 of the present disclosure includes lug 212 having a weakened section 222 (one shown) as one of the modification guide features and a plurality of pilot sections 224 as the other modification guide feature. Connector 210 can include, in some embodiments, an inspection window 234 defined in second region 214, which allows the user to ensure that the conductor is fully seated within second region 214—namely that the end of the conductor abuts the portion of second region 214 proximate the window.

Weakened section 222 is a pair of recess defined in lug 212 that forms an area of breakage of the lug, which provides a guide to the user for changing the length and/or width of the lug. Weakened section 222 are shown in the illustrated embodiment as a pair of continuous recess that runs perpendicular to the lug axis, runs across the entire width of lug 212, and are defined on top and bottom surfaces 236, 238 of the lug. Additionally, weakened sections 222 are shown in the illustrated embodiment as having a squared off cross section. In this manner, weakened section 222 is configured to allow the user to modify the length of lug 212—namely shorten the dimension of the lug along the lug axis.

Of course, it is contemplated by the present disclosure for weakened section 222 to be continuous or discontinuous, to run parallel to the lug axis, to run angled with respect to the lug axis, to run across less than the entire width of the lug, to have any desired cross section, and any combinations thereof.

Weakened sections 222 allows a user to break lug 212 in a controlled and repeatable manner to any desired length and/or width-based on the number and location of the weakened sections. For example, the user can bend lug 212 at weakened section 222 one or more times and, through metal fatigue, break the lug at the weakened section. As another example, weakened section 222 can be used as a pilot line to guide the user when cutting at the weakened section with a saw or cutter/snips. Advantageously, connector 210 is configured so that weakened section 222 is positioned on lug 212 in a manner that ensures maintenance of the desired compliance to the various regulatory and overseeing bodies when modified in the field.

The second of the modification guide features, a plurality of pilot sections 224, are also described in more detail with reference to FIGS. 6 and 7. Again, lug 212 is considered a blank lug in that it lacks any hole. Rather, connector 210 is configured with the plurality of pilot sections 224 that allow the user can modify the lug as needed by drilling one or more thru-holes in lug 212 to the desired diameter and spacing which suits the particular application.

Pilot sections 224 are at least a printed or indicia lines or markings that provide predefined locations on lug 212 as a template to the user to eliminate any guesswork in locating or spacing of thru holes and to speed up the process of creating the holes for the installation of hardware and completion of the application.

In some embodiments, pilot sections 224 can include one or more surface depressions in the surface of lug 212. The surface depressions may be provided at any number of industry standard spacings for the holes. Accordingly, pilot sections 224 provides the unmodified connector 210 of FIGS. 6 and 7 with a locator template ready for the user to be used as a guide to modify the connector to any desired pattern for one or more holes.

It should be recognized that pilot sections 224 are disclosed herein as being present on top surface 238 of lug 212. However, it is contemplated by the present disclosure for pilot sections 224 to defined in/or bottom surface 236 and/or on both the top and bottom surfaces, and any combinations thereof.

Connector 210 combines both weakened section 222 and pilot sections 224 to provide lug 212 with previously unavailable flexibility and modifiability, while remaining capable of maintaining the desired compliance to the various regulatory and overseeing bodies when modified in the field.

Figure 8:
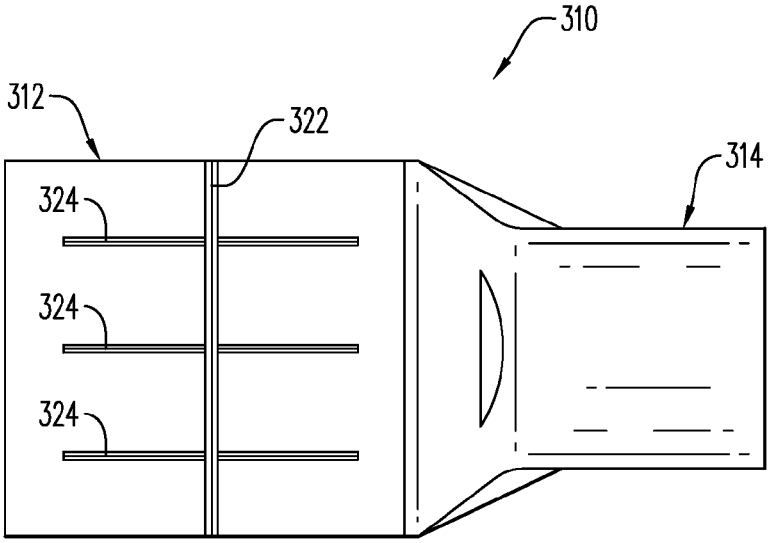
FIG. 8 is a top view of another exemplary embodiment of an electrical connector according to the present disclosure before modification.
Figure 9:
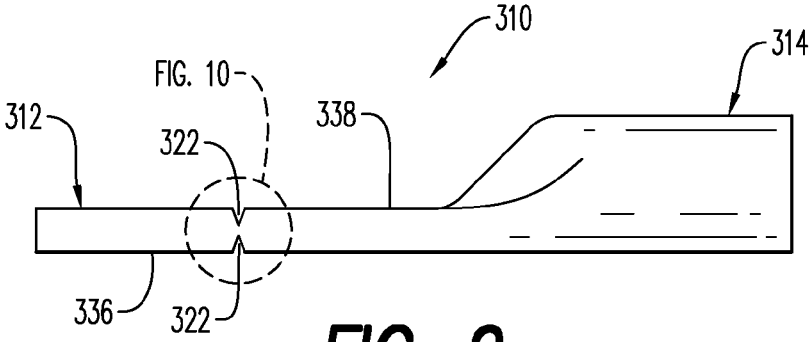
FIG. 9 is a side view of the electrical connector of FIG. 8.
Figure 10:
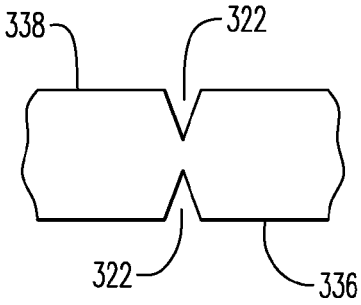
FIG. 10 is an enlarged view of the electrical connector of FIG. 9 taken at circle 9.

Another alternate embodiment of an electrical connector according to the present disclosure is shown in FIGS. 8-10 and is generally referred to by reference numeral 310. Here, component parts performing similar and/or analogous functions to those described above with respect to connector 10 are numbered in multiples of 300.

Connector 310 includes a lug 312 and a second region 314 and is shown in FIGS. 8-10 before modification. Again, connector 310 includes lug 312 having at least two different modification guide features that assist the user to modify the lug the from its blank or unmodified state and ensures that the modified lug maintains the desired compliance to the various regulatory and overseeing bodies when modified in the field.

Connector 310 includes lug 312 having a weakened section 322 (one shown) as one of the modification guide features and a plurality of pilot sections 324 (three shown) as the other modification guide feature.

Weakened section 322 is a pair of recess defined in lug 312 that forms an area of breakage of the lug, which provides a guide to the user for changing the length and/or width of the lug. Weakened section 322 are shown in the illustrated embodiment as a pair of continuous recess that run perpendicular to the lug axis, runs across the entire width of lug 312, and are defined on top and bottom surfaces 336, 338 of the lug. Additionally, weakened sections 322 are shown in the illustrated embodiment as having a v-shaped cross section. In this manner, weakened section 322 is configured to allow the user to modify the length of lug 312—namely shorten the dimension of the lug along the lug axis.

Of course, it is contemplated by the present disclosure for weakened section 322 to be continuous or discontinuous, to run parallel to the lug axis, to run angled with respect to the lug axis, to run across less than the entire width of the lug, to have any desired cross section, and any combinations thereof.

Weakened sections 322 allows a user to break lug 312 in a controlled and repeatable manner to any desired length and/or width-based on the number and location of the weakened sections. For example, the user can bend lug 312 at weakened sections 322 one or more times and, through metal fatigue, break the lug at the weakened section. As another example, weakened section 322 can be used as a pilot line to guide the user when cutting at the weakened section with a saw or cutter/snips. Advantageously, connector 310 is configured so that weakened sections 322 are positioned on lug 312 in a manner that ensures maintenance of the desired compliance to the various regulatory and overseeing bodies when modified in the field.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. An electrical connector comprising:

a conductor-connecting region; and a terminal-connecting region having a lug axis and at least two different modification guide features, which are configured to assist a user to modify the terminal-connecting region from a blank or unmodified state to a modified state, wherein one of the two different modification guide features comprises a weakened section that is perpendicular to the lug axis, and wherein another of the two different modification guide features comprises a pilot section selected from the group consisting of printed indicia, a score line, a depression line, and combinations thereof that run along the lug axis.

2. The electrical connector of claim 1, wherein the weakened section is configured so that the user can modify a dimension of the terminal-connecting region along the weakened section.

3. The electrical connector of claim 2, wherein the weakened section is on a surface of the terminal-connecting region selected from the group consisting of a top surface, a bottom surface, and combinations thereof.

4. The electrical connector of claim 2, wherein the weakened section comprises a plurality of weakened sections.

5. The electrical connector of claim 2, wherein the dimension is selected from the group consisting of a length of the terminal-connecting region, a width of the terminal-connecting region, and combinations thereof.

6. The electrical connector of claim 2, wherein the pilot section is configured so that the user can modify the terminal-connecting region to include one or more holes at the pilot section.

7. The electrical connector of claim 6, wherein the pilot section comprises a plurality of pilot sections.

8. The electrical connector of claim 6, wherein the pilot section is on a surface of the terminal-connecting region selected from the group consisting of a top surface, a bottom surface, and combinations thereof.

9. The electrical connector of claim 1, wherein the pilot section is configured so that the user can modify the terminal-connecting region to include one or more holes at the pilot section.

10. The electrical connector of claim 9, wherein the pilot section is the score line or the depression line and has sufficient depth to provide a pilot or guide to prevent walking or wandering of a drill bit during field modification to the modified state, but without affecting a structural rigidity of the terminal-connecting region.

11. An electrical connector comprising:

a conductor-connecting region; and a terminal-connecting region having a blank or unmodified state that is modifiable by a user to a modified state, the terminal-connecting region comprising a plurality of weakened sections configured allow the user to modify the terminal-connecting region so that the modified state is selected from the group consisting of a modified a length of the terminal-connecting region, a modified width of the terminal-connecting region, and combinations thereof, and the terminal-connecting region comprising a plurality of pilot sections configured allow the user to modify the terminal-connecting region so that the modified state is selected from the group consisting of a number of holes, a location of holes, a size of holes, and combinations thereof, wherein the plurality of pilot sections are score or depression lines that run along an axis of the terminal-connecting region and have sufficient depth to provide a pilot or guide to prevent walking or wandering of a drill bit during field modification to the modified state, but without affecting a structural rigidity of the terminal-connecting region.

12. The electrical connector of claim 11, wherein the plurality of weakened sections are on a surface of the terminal-connecting region selected from the group consisting of a top surface, a bottom surface, and combinations thereof.

13. The electrical connector of claim 11, wherein the plurality of pilot sections are on a surface of the terminal-connecting region selected from the group consisting of a top surface, a bottom surface, and combinations thereof.

14. An electrical connector comprising:

a conductor-connecting region;

a terminal-connecting region extending from the conductor-connecting region along a lug axis, the terminal-connecting region having a top surface and a bottom surface;

a weakened section on the bottom surface and perpendicular to the lug axis, the weakened section being configured to allow a user to break the terminal-connecting region to change a length of the terminal-connecting region along the lug axis; and a score or depression line on the top surface and parallel to the lug axis, the score or depression line having sufficient depth to provide a pilot or guide to prevent walking or wandering of a drill bit during drilling of a hole along the score or depression line, wherein the depth is insufficient to affect a structural rigidity of the terminal-connecting region.

* * * * *